United States Patent [19]

Roy

[11] 4,182,227

[45] Jan. 8, 1980

[54] VENTILATION DIFFUSER

[76] Inventor: Michel Roy, 856 du Parc, Duvernay (Laval), Quebec, Canada, H7E 2T6

[21] Appl. No.: 878,689

[22] Filed: Feb. 17, 1978

[51] Int. Cl.[2] ..... F24F 13/06

[52] U.S. Cl. ..... 98/40 D; 98/40 B; 98/41 R

[58] Field of Search ..... 98/40 D, 40 R, 40 B, 98/40 E, 40 V, 41 R, 41 AV, 40 DL

[56] References Cited

U.S. PATENT DOCUMENTS

| | | | |
|---|---|---|---|
| 2,367,104 | 1/1945 | Demuth | 98/40 B |
| 2,504,472 | 4/1950 | Van Alsburg et al. | 98/40 D |
| 2,701,998 | 2/1955 | Walle | 98/40 D |
| 2,837,990 | 6/1958 | Tutt | 98/40 B |
| 3,033,097 | 5/1962 | Phillips | 98/40 B |
| 3,765,316 | 10/1973 | Skoch | 98/40 D |
| 3,812,770 | 5/1974 | Morozov | 98/40 D |
| 3,854,386 | 12/1974 | Hedrick | 98/40 D |
| 3,986,850 | 10/1976 | Wilcox | 98/40 D |

*Primary Examiner*—Henry C. Yuen

[57] ABSTRACT

A ventilation diffuser of the type used as a ceiling ventilation outlet and characterized by its adjustability to produce the desired flow output, to produce the desired directional flow pattern around it, to rooms of different sizes and to different positions relative to the inside walls of a building, and to ventilation outlet ducts of different sizes. This ventilation diffuser comprises a receptacle including a bottom and an open end opposite the bottom, a ventilation deflector adjustably displaceable in in-and-out direction in the open end and curved to produce an outward flow parallel to and against the ceiling, frictionally engaged male and female connection members to readily adjust the ventilation deflector relative to the receptacle and thus the ventilation output, a gate device having selectively tearable tabs regulating the ventilation output to selectively define a desired directional flow pattern around the diffuser, and clips to snappingly secure the diffuser in an aperture of the ceiling.

5 Claims, 7 Drawing Figures

VENTILATION DIFFUSER

This invention relates to a ventilation diffuser of the type used in a building as a ceiling ventilation outlet.

Comfortable ventilation of a room or space in a building requires that the air flow does not exceed a speed of 20 to 30 feet per minute at six feet from the floor. The ventilation diffusers which have been proposed so far are not adapted to be readily adjusted to meet this basic requirement irrespective of the strength of the air flow issuing from the air supply duct. Besides, the ventilation diffusers which have been proposed so far have one or more of the following disadvantages: they produce a downward draft which causes discomfort for the occupant of the corresponding room or space, they cannot be placed relatively near a wall without producing adverse bouncing of the ventilation flow against that wall, and they are not suitable or adapted to selectively adjust the outward flow around the diffuser and thus suit any particular application.

It is a general object of the present invention to provide a ventilation diffuser of the above type which substantially avoids the above-mentioned disadvantages.

It is another general object of the present invention to provide a ventilation diffuser of the above type which is readily adjustable to suit very different locations in a room or a building, such as in a corridor or in a corner, and to produce a preferred flow pattern around it.

It is another object of the present invention to provide a ventilation diffuser of the above type wherein the ventilation flow outward thereof issues substantially parallel and remains along the ceiling to so propagate outwardly away from the ventilation diffuser.

It is a further object of the present invention to provide a ventilation diffuser of the above type which is adapted to selectively set the directional flow pattern around it according to any particular need to avoid undesirable bouncing against any nearby wall, partition, or obstacle and to prevent unwanted flow in any angular direction around the diffuser.

It is still another object of the present invention to provide a ventilation diffuser of the above type whose flow output is readily adjustable merely by hand adjustment.

It is a still further object of the present invention to provide a ventilation diffuser of the above type which is readily adapted to be connected to an air supply ventilation duct of any of a plurality of custom sizes.

The above and other objects and advantages of the present invention will be better understood with reference to the following detailed description of a preferred embodiment thereof which is illustrated, by way of example, in the accompanying drawings; in which.

The illustrated ventilation diffuser is adapted to be connected to the free end of a ventilation duct 1 which in this case is shown of circular cross-section. As will be explained in details later, the present ventilation diffuser is adapted to be connected to a ventilation duct of either circular or square cross-section and of any of a plurality of sizes.

The illustrated ventilation diffuser is mounted in an aperture 2 and recess in a ceiling 3.

Figure 7:
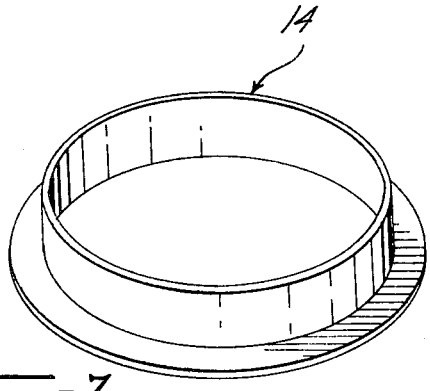
FIG. 7 is a perspective view of a collar used to secure a tight fitting between the end of a ventilation duct and the illustrated ventilation diffuser.

This ventilation diffuser comprises a receptacle 4 of square configuration whose walls includes a bottom 5, peripheral side wall 6, and an outward flange 7. The receptacle 4 has an open face opposite to the bottom 5. The latter is formed with severance lines 8, 9, 10, 11, 12, and 13 formed by grooves in register at the outside and inside faces of the bottom. The grooves or severance lines 8 and 9 allow to readily cut the bottom 5 to form a circular aperture of any of two sizes corresponding to existing sizes of circular ventilation ducts. Similarly, the grooves or severance lines 10, 11 and 12 provide for fitting the central aperture to anyone of three known sizes of square ventilation air ducts. A collar 14, shown in FIG. 7, is used at the junction of the ventilation duct 1 with the bottom 5 to form a tight connection between the duct and the bottom.

The receptacle 4 is secured to the ceiling panel 3 by spring clips 15. Each clip 15 includes a longer end 16 which abuts against the top of the ceiling panel and a downward projection 17 which is inserted in a slot 18 of the flange 7. The projection 17 has notches 19 to lock the clip in biased or clamping position upon engagement of the edge of the corresponding slot 18 in one of the notches 19.

A ventilation deflector member 20 is adjustably displaceable to and fro relative to the open face of the receptacle and such as to adjust the space for the ventilation flow outwardly between the receptacle flange 7 and the deflector member. The latter has a conically raised central portion 21 which forms a ventilation deflecting surface 22 of advantageous curvature. This ventilation deflecting surface includes an outer edge or flange portion 23 and an inner curved portion 24. The outer portion 23 extends parallel to the ceiling panel 3 and the inner portion 24 upwardly curves progressively inward with respect to the receptacle.

A connection is provided to adjust the ventilation deflector member 20 relative to the receptacle. This connection includes four pairs of a male and female connection members at the corners respectively of the square deflector member 20 and receptacle 4. The female connection member constitutes a speed clips 25 preferably made of steel and fixed to the flange 7 and the male connection member constitutes a pin 26 frictionally adjustable endwise in the clip 25. Thus, the mere endwise sliding of the pins 26 in the clip 25 produces the adjustment of the ventilation output between the deflector member 20 and the outer flange 7. The outward flow along the curved deflecting surface results in a flow parallel to and against the ceiling.

Figure 1:
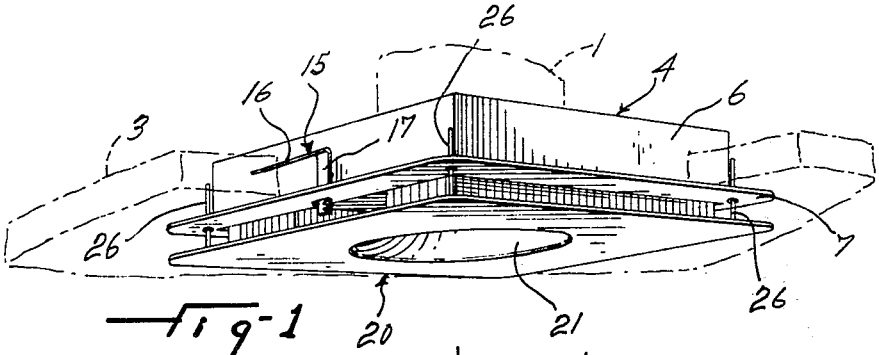
FIG. 1 is a perspective view of a ventilation diffuser according to the present invention.
Figure 2:
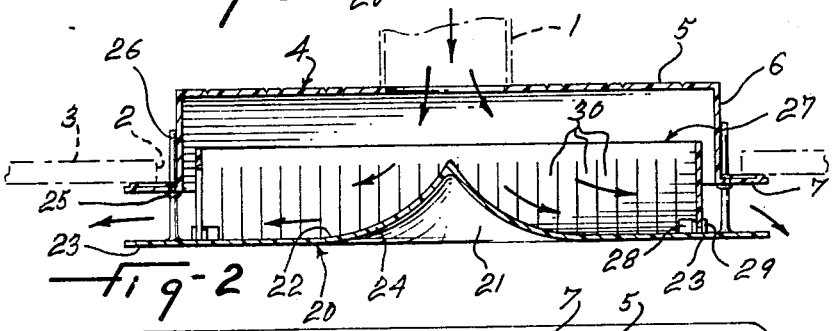
FIG. 2 is a cross-sectional view of the same ventilation diffuser, as seen along line 2—2 in FIG. 3.
Figure 3:
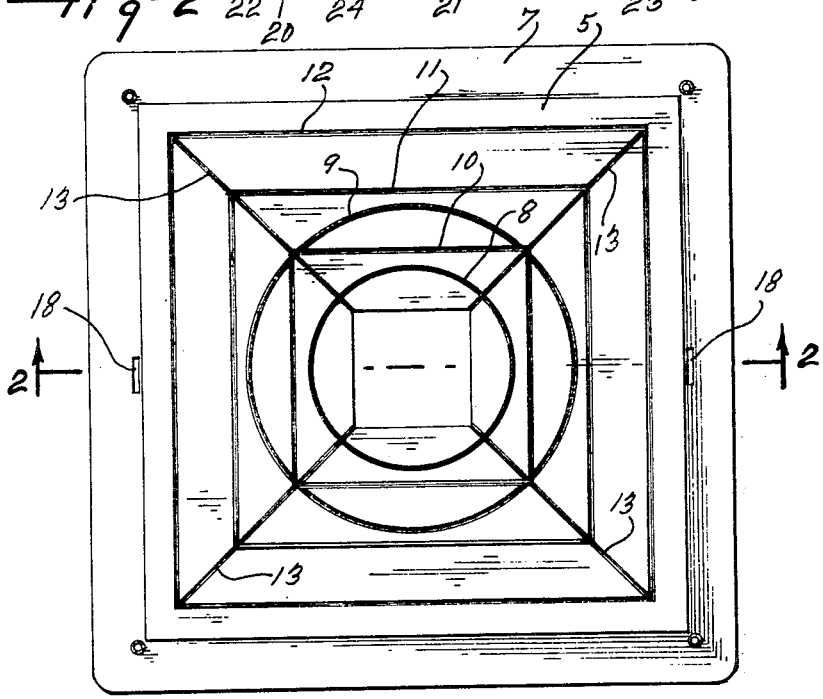
FIG. 3 is a top view of the ventilation diffuser of FIG. 1.
Figure 4:
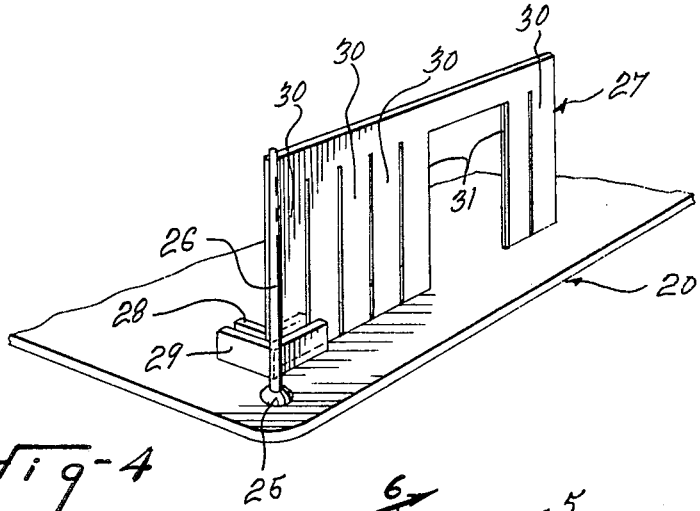
FIG. 4 is a perspective view of portion of the same ventilation diffuser particularly illustrating a gate device forming part thereof.
Figure 5:
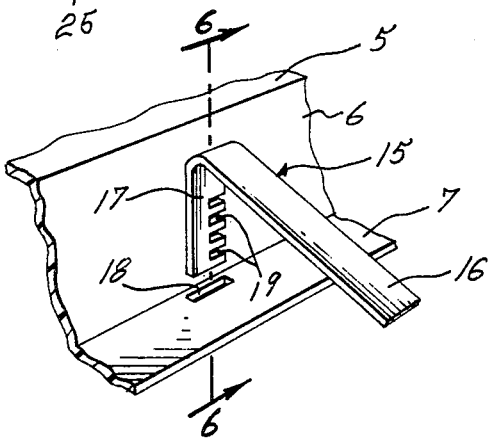
FIG. 5 is a perspective view of a clip used to conveniently fix the ventilation diffuser in an aperture of a ceiling.
Figure 6:
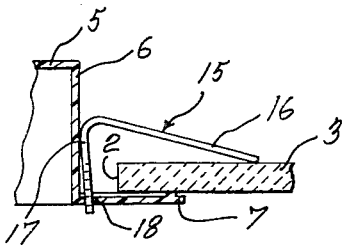
FIG. 6 is a cross-sectional view as seen along line 6—6 in FIG. 5.

A gate 27 is mounted on the deflector member 20 and constitutes a partition inwardly positioned relative to the peripheral side wall of the receptacle and longitudinally extending lengthwise of the latter to extend in the path of the outward flow, indicated by the arrows in FIG. 2. The gate 27 is formed of side strips which cooperatively define a closed perimeter. Each side strip is held edgewise onto the ventilation deflector member 20 by a pair of spaced-apart angles 28 and 29 at each corresponding corner of the gate. Each side strip of the gate 27 includes a series of tearable tabs 30 which downwardly project endwise from the upper edge portion thereof and are serially juxtaposed in lateral edgewise adjoining relationship. As shown in FIG. 4, some of the tearable tabs 30 are selectively cut or removed to form an outlet passage 31 of any desired width and at any desired angular position around the diffuser upon installation of the latter. Thus, when the diffuser is installed in any particular location, the appropriate tabs 30 are removed to form a flow pattern around the diffuser which avoids bouncing of the ventilation flow against a nearby wall or obstacle and an undesirable speed of flow in any particular direction.

The receptacle 4, the deflector member 20, and the pins 26, and the gate 27 are made of plastic, which allows smooth frictional sliding of the pins 26 in the clips 25, easy severance along any particular severance cut 8–12, and easy cutting or shearing of any tearable tab 30.

What I claim is:

1. A ventilation diffuser comprising a receptacle having a bottom and side walls, said side walls having free edges defining a receptacle open face spaced from said bottom, said receptacle adapted to be positioned in a recess of a ceiling in upside down position with the free edges of said side walls substantially flush with said ceiling, said bottom having an air inlet aperture means adapted to be connected to an air supply duct, an air deflector member in register with and extending across said open face and having a flat outer edge portion substantially parallel with said ceiling and extending outwardly of said side walls and downwardly spaced therefrom and defining with the free edges of said side walls an air outlet extending all around said receptacle, said air deflector member having an inner portion upwardly curving toward said bottom, progressively inward of said side walls, adjustable connection means between said air deflector member and said receptacle adjustably securing said air deflector member at a selected distance of its outer edge portion from the free edges of said side walls, partitions removably resting on said air deflector member and upstanding within said receptacle inwardly of said side walls and substantially parallel thereto, each partition having a continuous upper marginal portion and a series of tearable, elongated tabs downwardly projecting endwise from said upper marginal portion and juxtaposed side by side lengthwise of said partition, the free lower edge of said tabs defining the free lower edge of said partition, whereby said tabs can be selectively removed to produce air passages in selected directions relative to said receptacle, said air passages establishing a communication between said air inlet aperture means and said air outlet.

2. A ventilation diffuser as claimed in claim 1, further including mutually spaced rib means upstanding from said air deflector member, the free lower edge of said partition removably engaged between rib means.

3. A ventilation diffuser as claimed in claim 1, wherein said bottom has a set of severance lines in the form of closed perimeters of predetermined sizes and corresponding to air ducts of the same sizes, respectively, and forming said air inlet aperture means and providing for selective connection of said receptacle to a duct of one of said sizes upon severance of said bottom along the corresponding severance line.

4. A ventilation diffuser as claimed in claim 1, for use in association with a suspended ceiling, said receptacle having a peripheral outwardly extending flange depending from the free edge of said side walls and adapted to abut the underside of said ceiling, and spring clips for securing said receptacle to said ceiling within said recess, each spring clip having a generally L-shape with one downwardly extending leg portion adjustably extending and adjustably removably secured in a hole made through said flange, and a second leg portion extending outwardly of said receptacle and adapted to resiliently abut the top of said ceiling.

5. A ventilation diffuser as claimed in claim 4, wherein said adjustable connection means includes pins upstanding from, and secured to, the outer edge portion of said air deflector member, and a female connection member for each pin carried by said peripheral outwardly extending flange, said female connection member consisting of a clip through which said pin extends and is frictionally retained in adjusted position.

* * * * *